United States Patent [19]

Lautjärvi et al.

[11] 4,109,898

[45] Aug. 29, 1978

[54] METHOD AND A DEVICE FOR ADDING SOLID, POWDERED OR GRAINED MATERIAL TO MELTED METAL

[76] Inventors: Jaakko Lautjärvi, Kuljunniemi B; Raimo Eriksson, Kuljunniemi A, both of 92160 Saloinen, Finland

[21] Appl. No.: 688,432

[22] Filed: May 20, 1976

[30] Foreign Application Priority Data

May 21, 1975 [FI] Finland ..... 751479

[51] Int. Cl.[2] ..... C21C 7/00

[52] U.S. Cl. ..... 266/217; 266/225

[58] Field of Search ..... 75/53, 93 A, 61, 129, 75/130 A, 130 B, 130 C, 130 AB, 130 R; 266/216, 217, 225, 226

[56] References Cited

U.S. PATENT DOCUMENTS 905,948 12/1908 Stromborg ..... 266/217

FOREIGN PATENT DOCUMENTS 47-51,681 12/1972 Japan ..... 266/217
370,238 4/1973 U.S.S.R. ..... 266/216
292,912 3/1971 U.S.S.R. ..... 266/217

*Primary Examiner*—Gerald A. Dost
*Attorney, Agent, or Firm*—Allan R. Fowler

[57] ABSTRACT

A method and a device for adding solid, powdered or grained material to melted metal includes the steps of and apparatus for inserting a tubular member below the surface of melted metal, blocking the rise of metal into the tube by means of gas pressure, introducing additive material into the tubular member and rotating the tubular member to sling additive material from the tubular member into the melted metal.

1 Claim, 1 Drawing Figure

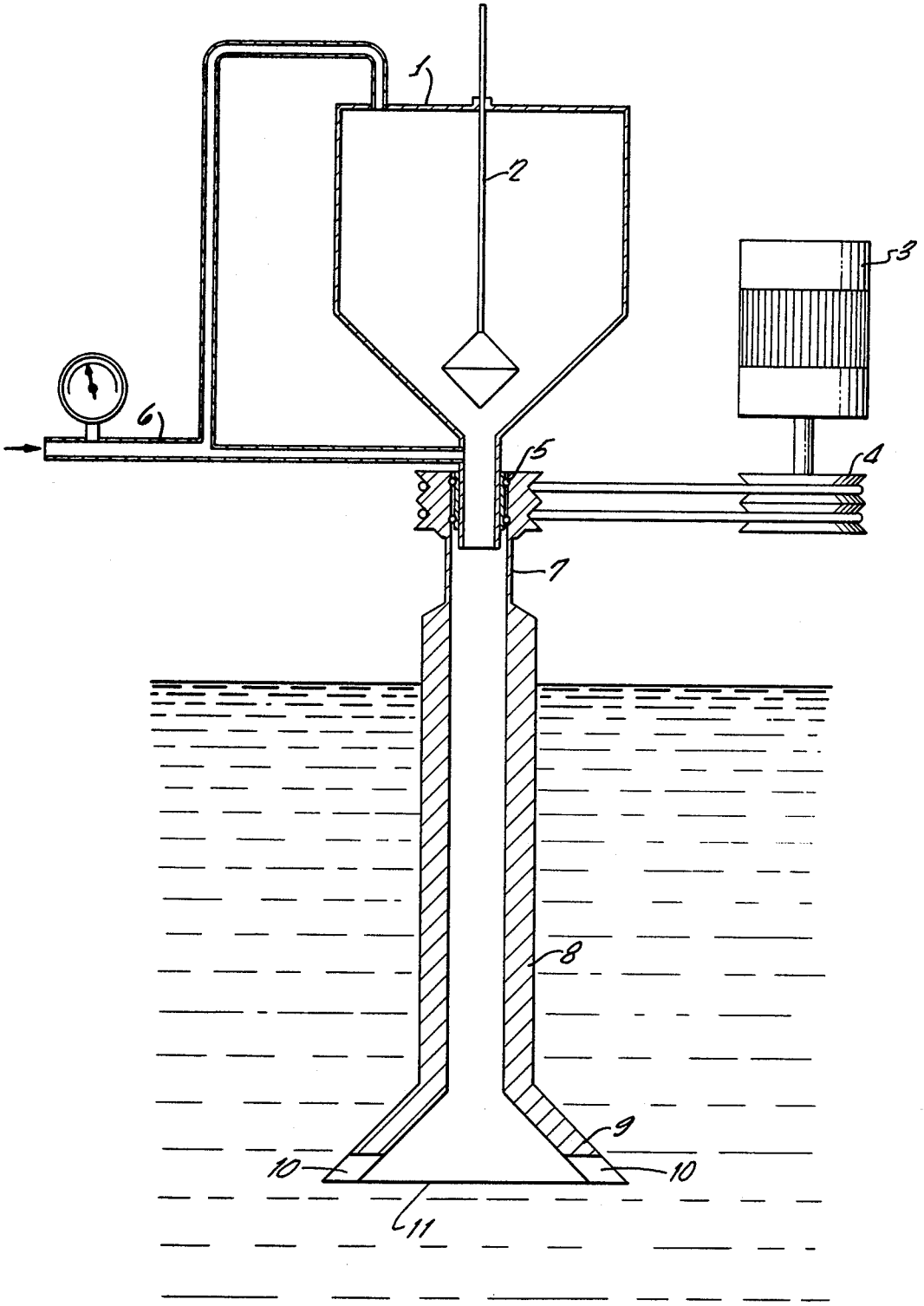
1
2
3
4
5
6
7
8
9
10
10
11

METHOD AND A DEVICE FOR ADDING SOLID, POWDERED OR GRAINED MATERIAL TO MELTED METAL

After the melting the melted metal is poured into a bucket in which further processing, e.g. alloying and removal of impurities, is often performed. In case the material to be added is solid, the addition can be performed either by immersion or by injection with a carrier gas.

A general drawback with presently known methods is the varying availability of the material to be added. Especially, if the question is about the addition of a metal insoluble material (raffination process), the consumption of the effective material is considerably greater than in ideal case.

By means of the device according to the invention the effective material can be added below the surface of the melted metal as powdered or grained. As a distinction from injection, the addition with the present device takes place without a carrier gas by slinging the material into the melt.

It has been proved experimentally that the slinging succeeds without a carrier gas, and that with the application tested better economic result is obtained than with currently used methods.

In the attached drawing there is illustrated the principle of the device used in the tests. All essential parts for the operation of the device appear there.

The device can be placed on a special stand where it can be raised and lowered, or it can also be suspended from a crane hook.

Material to be added is drained from the container 1 by adjusting the closing device 2 into the tube 7. Prior to this the device has been immersed in the melt, as shown in the figure. The admission of the melted metal into the tube 7 and its specially designed lower part 9 has been blocked by supplying appropriate gas into the tube 6. The tube to be immersed has been coated with a material which can resist the heat effect and chemical effect of melted metal.

The tube is set in axial rotation by means of the motor 3, transmission means 4 and set of bearings 5. Thus the material drained from the container, after its arrival at the limit surface of the liquid, will be flinged by the action of rotating motion of the specially designed lower end past the hem of the lower end and into the melt.

The device has been applied to desulfurizing of melted crude iron, the effective material used having been grained magnesium metal. Grain shape must be such that the product easily drains from the container into the tube. Suitable discharge gases are nitrogen or argon. On the outside the tube is lined with shamot bricks. The conical lower end is also made of shamot, and grooving or radial openings 10 have been machined upwardly from a lower surface 11 in order to produce effective centrigal flow.

The melted crude iron to be processed is placed in a ladle. The tube member of the device which is ready for operation is immersed in the melted iron as nitrogen flows into the tube, whereby melted iron cannot rise into the tube. The nitrogen flow is adjusted to correspond to leakage which is why very little gas flows over the lower hem of the tube.

Rotating motion is actuated. It has been discovered that 120 rpm provides desired slinging action. When the tube has been immersed to suitable depth, the draining of magnesium grains is started. The grains are slinged into the melt where magnesium reacts in a known manner with sulfur dissolved in iron. Processing time is approximately 10 min.

In the above-described special case the process speed can be regulated with immersion depth and magnesium feeding speed and obtain optimum utilization of magnesium. Individual magnesium grains melt at the moment they are centrifugalized or slinged, and start to rise towards the surface of the melt as they are lighter than iron and iron insoluble. After rising to certain depth, the vapour pressure of magnesium exceeds the combined pressure of atmosphere and the melted metal, whereby liquid drop turns in a known manner into steam bubble. By varying the grain size of magnesium and design of the centrifuge end it can effected on the size of magnesium drops and thus on that of steam bubbles. Corresponding result cannot be obtained with presently known methods using magnesium.

The method also provides particular possibilities e.g. in desoxydation of melted steel and in alloying of melted cast iron and steel. A.o. in carbide process of melted steel the bubble size of produced calcium vapour can be regulated in accordance with carbide grain size. In other methods the regulation of bubble size is difficult because, e.g. in injection the bubble size is determined according to the bubble size of the carrier gas. In all cases the invented method can provide as preferable a yield of the material to be added as possible and in alloying very accurate content desired can be obtained.

What is claimed is:

1. A device for adding solid, granular or powdered material to melted metal, comprising:

(a) a container for containing material to be added to the melted metal, (b) a tube having an upper end and a lower portion, the lower portion being formed in diverging conical shape and having means defining an open lower end, the upper end of the tube being connected to the material container to enable material to flow downwardly through the tube, the tube being adapted for having the lower end portion immersed into melted metal, (c) gas pressurizing means for pressurizing the tube to a pressure substantially equal to that pressure just preventing flow of melted metal up into the tube when the lower portion is immersed into melted metal, (d) rotating means for axially rotating the tube at a speed causing material flowed downwardly through the tube to be slung outwardly through the open lower end into the melted metal in which the lower end is immersed and causing dispersion therein without substantial outflow of gas from the pressurizing means, and (e) means defining openings in the tube lower portion at the open lower end thereof, whereby slinging action of the rotating tube and dispersion of the material into the melted metal is enhanced.

* * * * *